US006620086B2

(12) United States Patent
Butler et al.

(10) Patent No.: US 6,620,086 B2
(45) Date of Patent: Sep. 16, 2003

(54) ONE-PASS SEAMING MACHINE FOR ASSEMBLING AN OVERSIZED TWO-PIECE BOX

(75) Inventors: Philip G. Butler, 621 Morelane Park Rd., Salisbury, NC (US) 28145; James Zaylor, Salisbury, NC (US)

(73) Assignee: Philip G. Butler, Salisbury, NC (US)

( * ) Notice: Subject to any disclaimer, the term of this patent is extended or adjusted under 35 U.S.C. 154(b) by 53 days.

(21) Appl. No.: 09/957,270

(22) Filed: Sep. 19, 2001

(65) Prior Publication Data

US 2003/0022776 A1 Jan. 30, 2003

Related U.S. Application Data

(60) Provisional application No. 60/308,419, filed on Jul. 27, 2001.

(51) Int. Cl.[7] ..... B31B 49/02
(52) U.S. Cl. ..... 493/141; 493/84
(58) Field of Search ..... 493/84, 127, 128, 493/141, 150, 374, 379

(56) References Cited

U.S. PATENT DOCUMENTS

| | | | | |
|---|---|---|---|---|
| 3,068,760 A | * | 12/1962 | Gross | 493/129 |
| 3,673,928 A | * | 7/1972 | Striplin | 493/23 |
| 3,800,677 A | * | 4/1974 | Jones et al. | 493/6 |
| 3,949,652 A | | 4/1976 | Aalpoel | |
| 3,986,441 A | | 10/1976 | Jaton | |
| 4,010,597 A | | 3/1977 | Nelson | |
| 4,023,790 A | * | 5/1977 | Gortowski | 493/399 |
| 4,185,565 A | | 1/1980 | Nymoen | |
| 4,222,311 A | | 9/1980 | Jaton | |
| 4,515,581 A | * | 5/1985 | Molitor et al. | 493/183 |
| 4,551,125 A | | 11/1985 | Pezzana et al. | |
| 4,557,472 A | * | 12/1985 | Hannon | 271/133 |
| 4,604,083 A | | 8/1986 | Barny et al. | |
| 4,746,321 A | | 5/1988 | Benedicenti | |
| 4,964,252 A | | 10/1990 | Guliker | |
| 5,086,547 A | | 2/1992 | Ziemelis | |
| 5,147,270 A | | 9/1992 | Gronnevik | |
| 5,651,225 A | | 7/1997 | Leeks | |
| 5,713,649 A | | 2/1998 | Swift | |
| 5,840,152 A | | 11/1998 | Billgren et al. | |
| 5,916,079 A | * | 6/1999 | Haring et al. | 493/125 |

OTHER PUBLICATIONS

Anvil Iron Works Inc.; "Gemini—2 Piece 1 Pass Gluer"; Brochure; 1–page; Published prior to Sep. 19, 2001.

* cited by examiner

*Primary Examiner*—Scott A. Smith
*Assistant Examiner*—Nathaniel Chukwurah
(74) *Attorney, Agent, or Firm*—Schwartz Law Firm, P.C.

(57) ABSTRACT

A box seaming machine assembles an oversized box including first and second box pieces. Each of the box pieces is folded to form top and bottom panels having respective proximal edges joined together at the fold and respective free edges opposite the joined edges. The free edges of the first box piece are adapted for being secured to the free edges of the second box piece to define first and second seams of the assembled box. The box seaming machine includes a pair of laterally-spaced, opposing drive roller assemblies adapted for movement between an idle position and an operative position. In the idle position, the drive roller assemblies are disengaged from the box pieces to enable alignment of the free edges prior to seaming. In the operative position, the drive roller assemblies frictionally engage the box pieces at respective folds and feed the box pieces downstream for seaming. First and second seam fasteners are located downstream of the drive roller assemblies for securing the seams at respective free edges of the first and second box pieces to form an assembled, two-piece box.

22 Claims, 10 Drawing Sheets

ONE-PASS SEAMING MACHINE FOR ASSEMBLING AN OVERSIZED TWO-PIECE BOX

This patent application claims priority to U.S. Provisional Patent Application No. 60/308,419 filed on Jul. 27, 2001. This invention relates to a one-pass seaming machine for securing the seams of an oversized, two-piece corrugated or paperboard box. Such boxes are commonly used for packaging large items, such as refrigerators, furniture, carts, lawn mowers, motorcycles, and the like.

TECHNICAL FIELD AND BACKGROUND OF THE INVENTION

In the packaging industry, the need to produce increasingly larger boxes quickly and economically demands the advent of an improved machine capable of simultaneously forming two seams in a two-piece oversized box. Today's commercially-available equipment is capable of stapling or gluing only one seam at a time. Because of the demand for larger sizes, most boxes generally require the use of separate box pieces and the formation of two seams. Forming an additional seam creates material handling problems and inefficient double feed requirements. Moreover, as the stapling process is becoming a less desirable method of seam fastening, many manufacturers rely on a hot glue method which is relatively expensive, and requires close attention to machine maintenance for continued operation. Cold glue methods appear to be a desirable alternative. The prolonged cure time, however, adds to the difficulties in material handling thus making this choice unattractive to most manufacturers.

In addition to the seam forming issues discussed above, larger boxes made with relatively heavy pieces are physically difficult to handle and feed into the seaming machine. The typical outside dimension of a large box piece may be 180"×any length, limited only by the material handling capabilities of the manufacturer. Prior to feeding, the heavy box pieces must be properly aligned. It is critical that the edges to be glued are matched up square and true, and remain in that condition throughout the seaming process. Processing speeds must also remain consistent between various handling components in order to prevent miss-feeds.

SUMMARY OF THE INVENTION

Therefore, it is an object of the invention to provide a box seaming machine which operates to form both seams of a two-piece box in a single pass.

It is another object of the invention to provide a box seaming machine which reduces the incidence of damage, skewing and miss-feeds.

It is another object of the invention to provide a box seaming machine which has an increased production rate.

It is another object of the invention to provide a box seaming machine which is capable of producing as many as one box every 20 seconds.

It is another object of the invention to provide a box seaming machine which utilizes either a cold set or hot melt glue, staples, or tape to secure the seams of the box.

It is another object of the invention to provide a box seaming machine which does not cause unwanted permanent creasing of the corrugated box panels.

It is another object of the invention to provide a box seaming machine which promotes an accelerated "cure" cycle compatible with the operating speed of the machine, thereby allowing use of a more cost-effective adhesive.

It is another object of the invention to provide a box seaming machine which simultaneously forms two seams joining the box pieces without the need for double handling.

It is another object of the invention to provide a box seaming machine which can be readily modified to utilize hot glue or staples as a fastening method without major changes to the machine.

It is another object of the invention to provide a box seaming machine which uses two glue heads capable of running independently to simultaneously produce two smaller boxes each with a single seam.

It is another object of the invention to provide a box seaming machine which is capable of seaming a square box.

These and other objects of the present invention are achieved in the preferred embodiments disclosed below by providing a box seaming machine for assembling an oversized box including first and second box pieces. Each of the box pieces is folded to form top and bottom panels having respective proximal edges joined together at the fold and respective free edges opposite the joined edges. The free edges of the first box piece are adapted for being secured to the free edges of the second box piece to define first and second seams of the assembled box. The box seaming machine includes a pair of laterally-spaced, opposing drive roller assemblies adapted for movement between an idle position and an operative position. In the idle position, the drive roller assemblies are disengaged from the box pieces to enable alignment of the free edges prior to seaming. In the operative position, the drive roller assemblies frictionally engage the box pieces at respective folds and feed the box pieces downstream for seaming. First and second seam fasteners are located downstream of the drive roller assemblies for securing the seams at respective free edges of the first and second box pieces to form an assembled, two-piece box.

According to another preferred embodiment of the invention, the drive roller assemblies are carried on a common drive shaft such that the box pieces are fed into the machine at corresponding rates.

According to another preferred embodiment of the invention, the drive roller assemblies include respective upper and lower rollers.

According to another preferred embodiment of the invention, the drive roller assemblies include respective lift carriages. Each of the lift carriages is mounted adjacent the lower roller such that when the drive roller assembly is in the idle position, the lift carriage supports the box piece above the lower roller. When the drive roller assembly is in the operative position, the lift carriage moves away from the box piece to position the box piece on the lower roller.

According to another preferred embodiment of the invention, the upper rollers are mounted to respective lift carriages, and move in unison with the carriages upon movement of the drive roller assemblies between the idle and operative positions.

According to another preferred embodiment of the invention, respective cylinders are provided for moving the drive roller assemblies between the idle and operative positions.

According to another preferred embodiment of the invention, a guide roller is located between the drive roller assemblies for supporting and guiding one or more of the box panels as the box pieces move downstream into the machine.

According to another preferred embodiment of the invention, the seam fasteners include respective upper and lower glue shoe assemblies adapted for simultaneously applying glue to respective free edges of the box pieces to secure the seams of the assembled box.

According to another preferred embodiment of the invention, the upper glue shoe assembly defines a cavity for storing a cold glue head.

According to another preferred embodiment of the invention, the upper glue shoe assembly includes an edge guide surface for guiding one of the first and second box pieces into the machine during seaming.

According to another preferred embodiment of the invention, the lower glue shoe assembly defines a cavity for storing a cold glue head.

According to another preferred embodiment of the invention, the lower glue shoe assembly includes an edge guide surface for guiding one of the first and second box pieces into the machine during seaming.

According to another preferred embodiment of the invention, the lower glue shoe assembly further includes a flat support surface extending perpendicular to the edge guide surface, and cooperating with the edge guide surface to square and align one of the first and second box pieces prior to seaming.

According to another preferred embodiment of the invention, the lower glue shoe assembly further includes a stop formed at a back end of the support surface, and extending perpendicular to the support surface to further square and align one of the first and second box pieces prior to seaming.

According to another preferred embodiment of the invention, a cylinder is provided for lowering the support surface of the lower glue shoe assembly to disengage the box piece from the stop prior to downstream movement of the box piece into the machine.

According to another preferred embodiment of the invention, first and second laterally-spaced compression arms are located downstream of the upper and lower glue shoe assemblies, and arranged to receive the assembled box pieces at the glued seams to compress the seams in a curing zone as the box pieces move downstream through the machine.

According to another preferred embodiment of the invention, first and second pairs of upper and lower nip rollers are located at respective leading ends of the compression arms, and cooperate to pull the box pieces from the glue shoe assemblies into the curing zone.

According to another preferred embodiment of the invention, the first and second compression arms extend downstream at an incline such that the box pieces are fed into the machine at a relatively low elevation, and are discharged from the machine at a higher elevation.

According to another preferred embodiment of the invention, a box elevator is located at an output end of the machine for receiving assembled boxes after seaming, and lowering the boxes to an elevation for unloading.

In another embodiment, the invention is a method of assembling an oversized box including first and second box pieces. Each of the box pieces is folded to form top and bottom panels having respective proximal edges joined together at the fold and respective free edges opposite the joined edges. The method includes the steps of aligning the box pieces at an in-feed section of a box seaming machine such that the free edges of the top panels of the box pieces overlap to form a first seam, and the free edges of the bottom panels of the box pieces overlap to form a second seam. The box pieces are then clamped at respective folds between upper and lower rollers of respective first and second drive roller assemblies. The drive roller assemblies are then actuated in unison to move the box pieces downstream at corresponding feed rates. As the box pieces move downstream, the first and second seams are fastened to form an assembled, oversized box.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
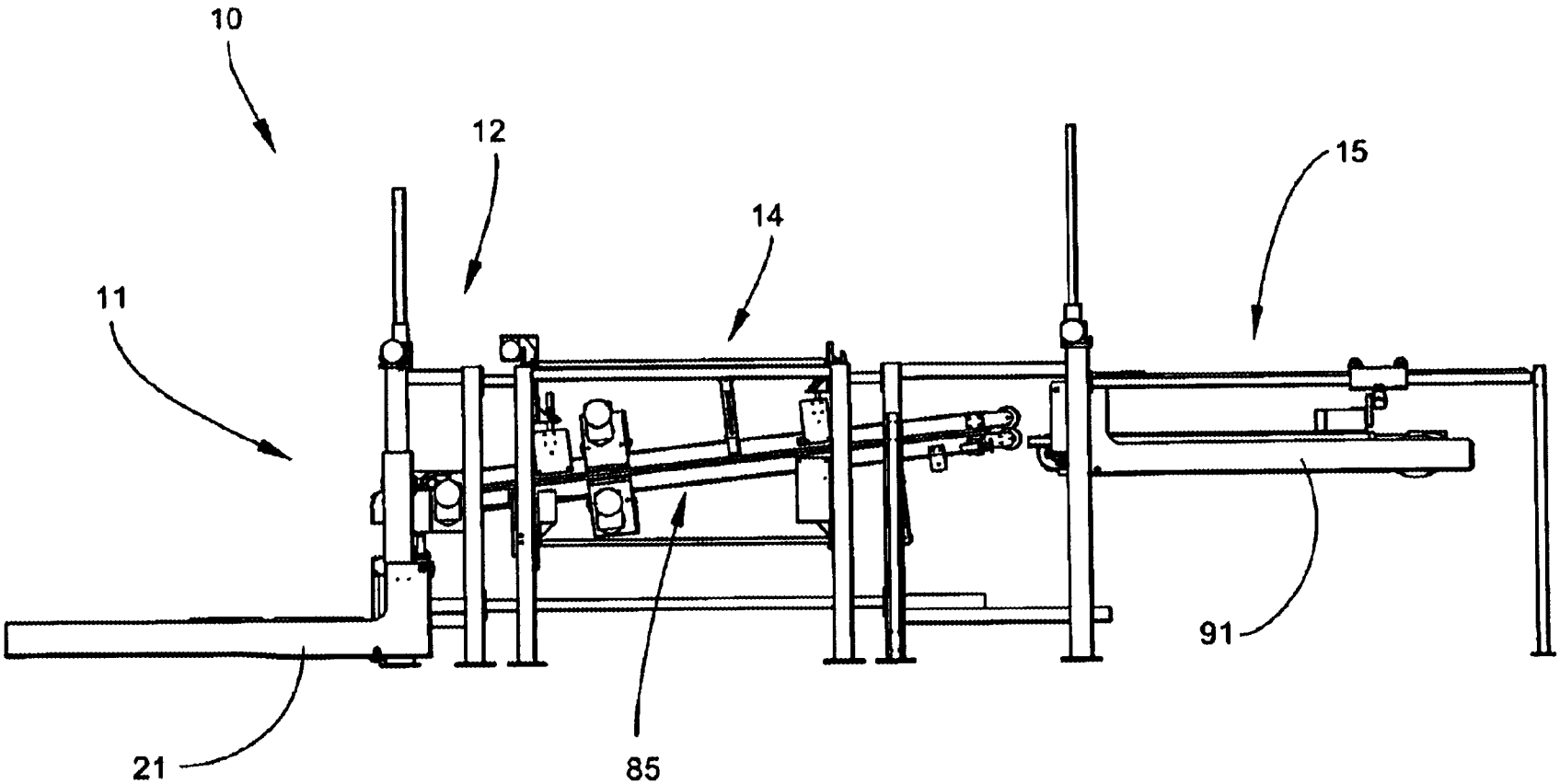
FIG. 1 is a side perspective view of a box seaming machine according to one preferred embodiment of the invention.

Referring now specifically to the drawings, a one-pass box seaming machine according to the present invention is illustrated in FIG. 1 and shown generally at reference numeral 10. The machine 10 operates to form the seams of a two piece, oversized box in a single pass. As indicated in FIG. 1, the machine 10 is constructed in four major sections including a material lift section 11, an in-feed section 12, a seam curing section 14, and a box output section 15. Each of these sections is described separately below.

Material Lift Section 11

Figure 2:
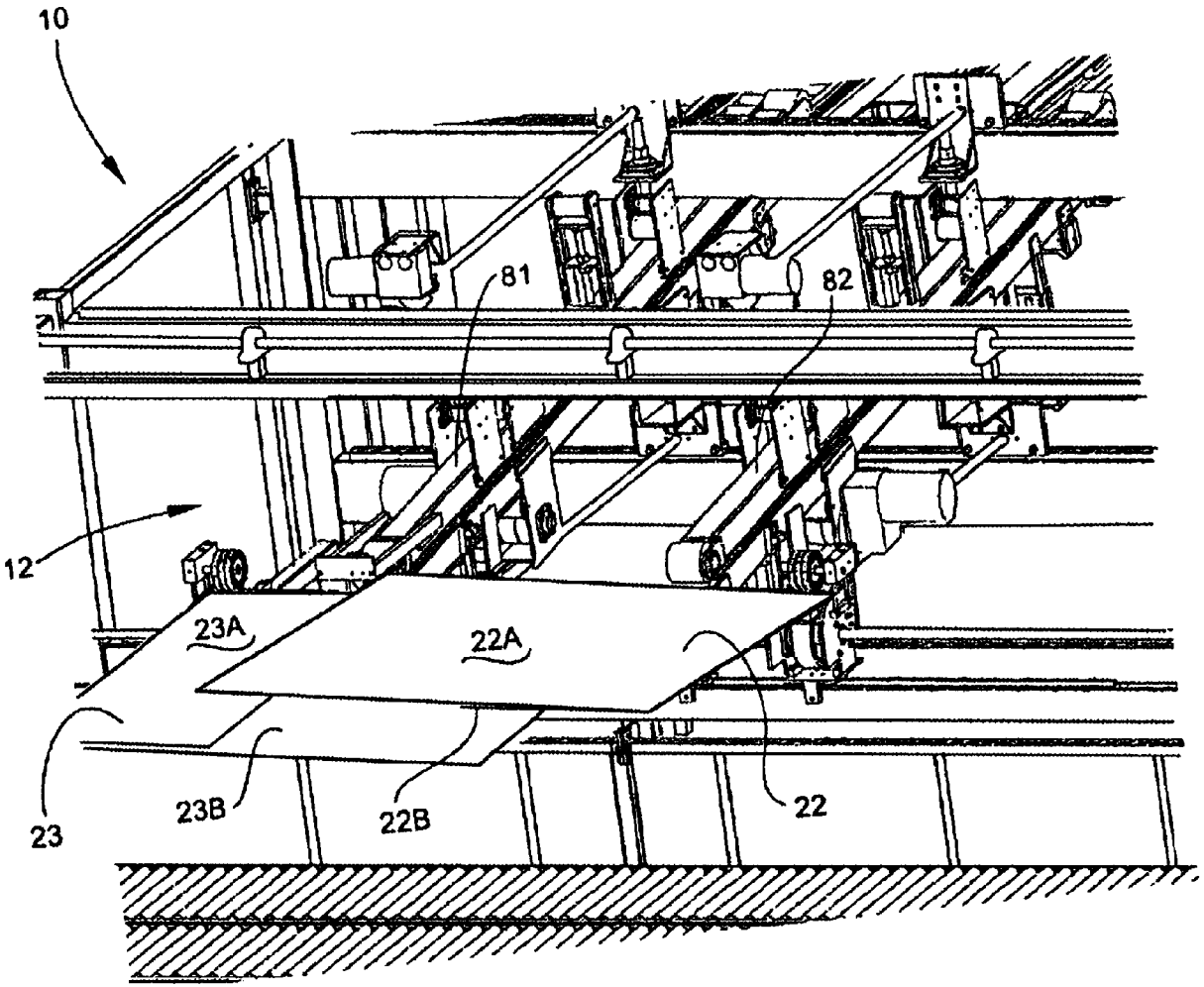
FIG. 2 is an enlarged fragmentary view of the box seaming machine, and showing two box pieces being fed into the in-feed section.
Figure 6:
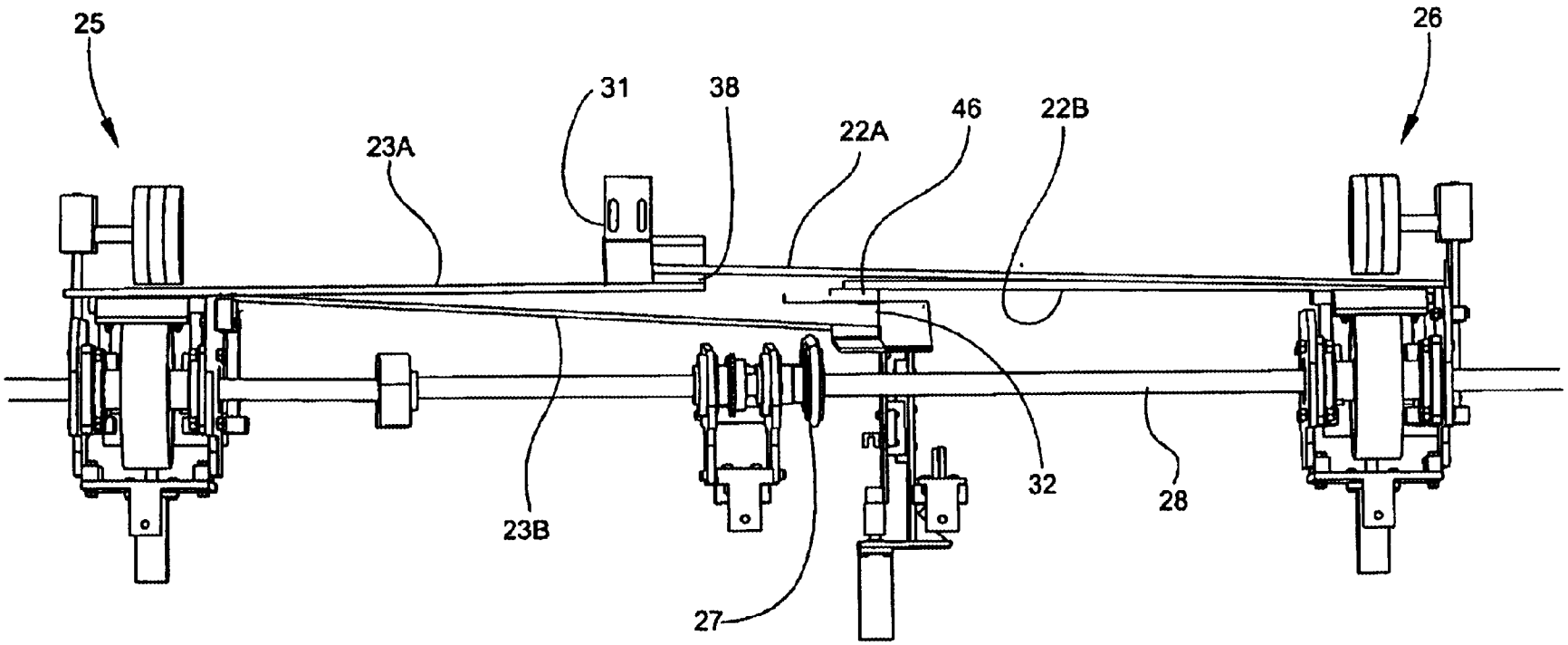
FIG. 6 is an end view showing components of the in-feed section of the machine with the drive roller assemblies in their raised, idle position to accommodate placement of the box pieces.
Figure 9:
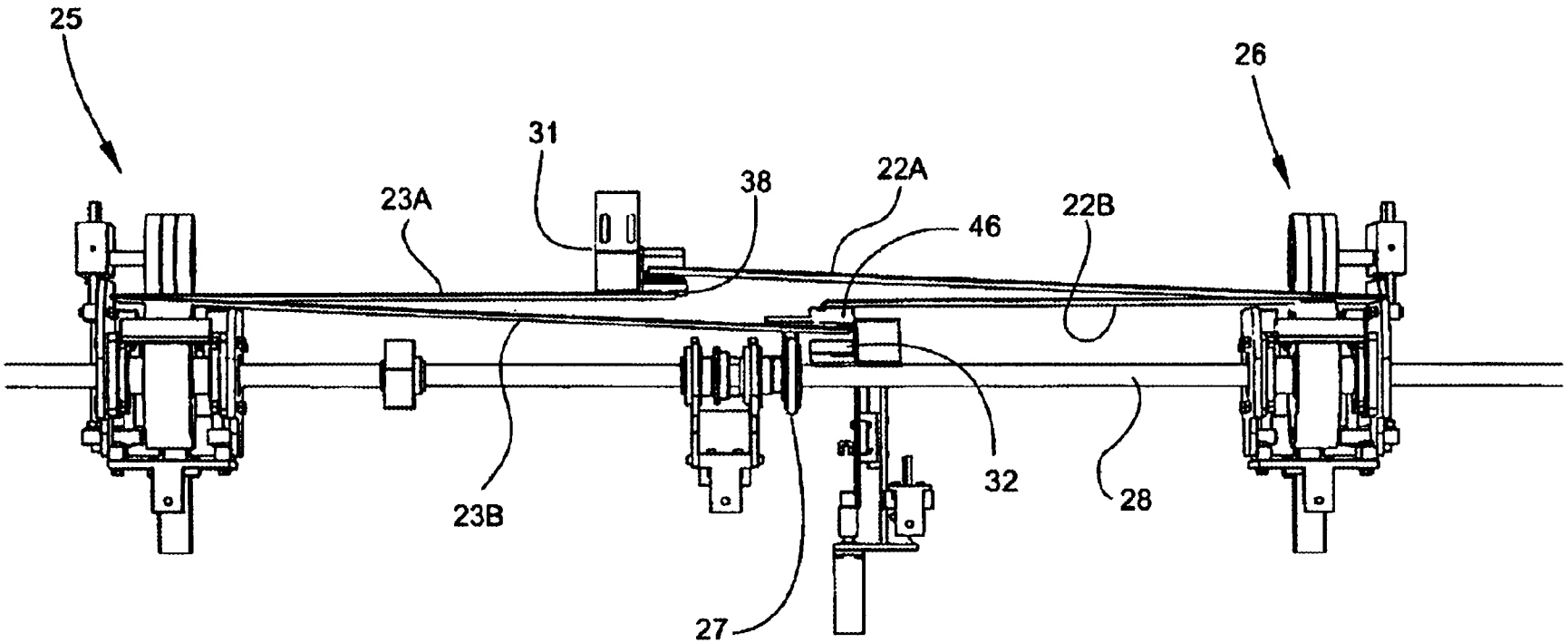
FIG. 9 is an end view showing components of the in-feed section of the machine with the drive roller assemblies in their lowered, operative positions for moving the box pieces downstream through the machine.
Figure 10:
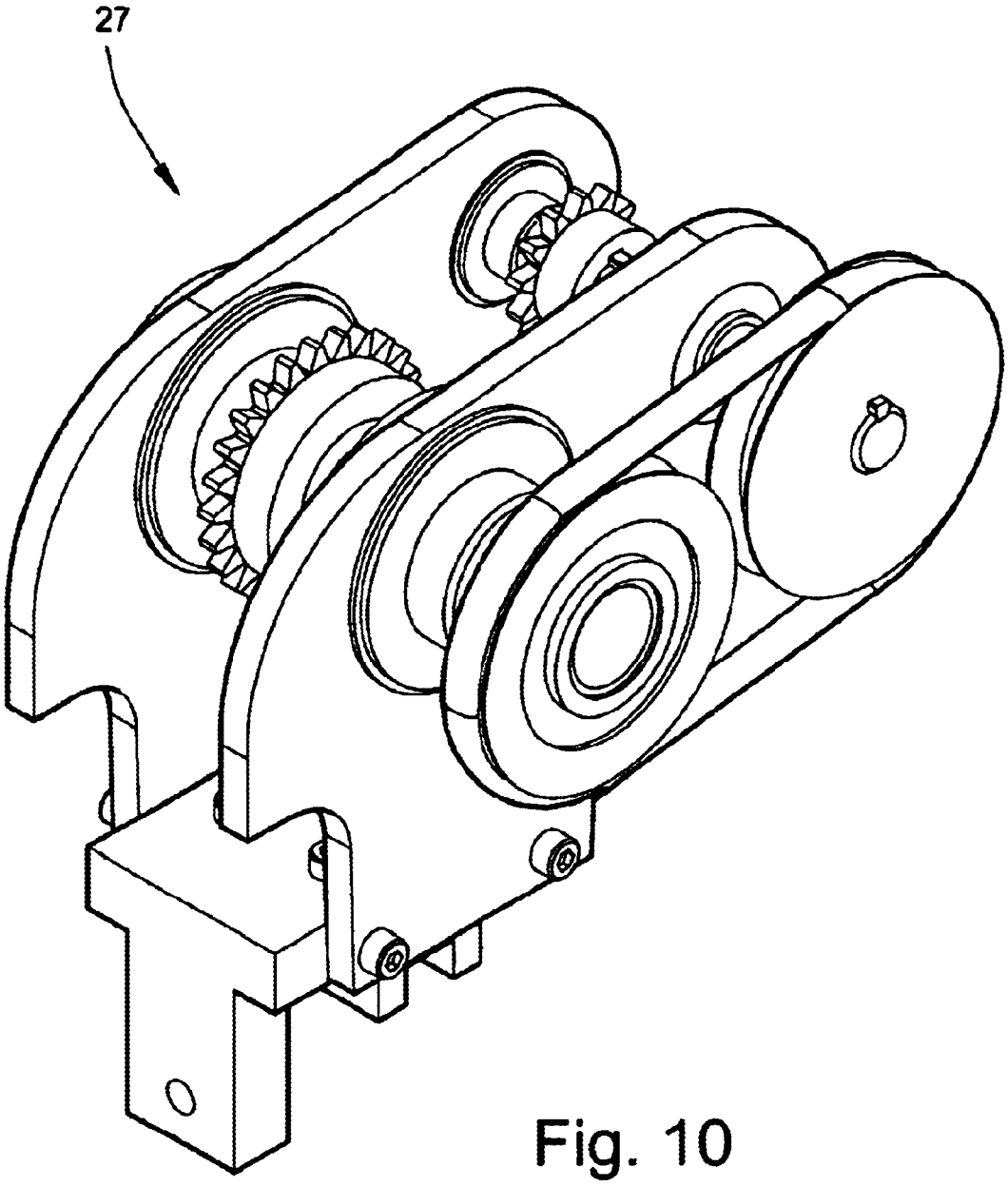
FIG. 10 is an isolated, perspective view of the guide roller.

The material lift section 11 includes a mechanical lift 21 operating at a front end of the machine 10 to elevate pallets of stacked, corrugated box pieces 22 and 23 (See FIG. 2) to a convenient location for manual feeding into the machine 10. The box pieces 22 and 23 are folded, as shown in FIGS. 2, 6, and 9, to form respective top and bottom panels 22A, 22B and 23A, 23B having respective joined proximal edges and respective free edges opposite the joined edges. The box pieces 22 and 23 are arranged on the pallets in complementary sets to facilitate alignment of the free edges of the two top panels 22A and 23A, and the free edges of the two bottom panels 22B and 23B.

The lift 21 is raised in increments from a ground elevation via an operator-controlled foot pedal which jogs the lift upwardly to the desired in-feed elevation. Two operators, one on each side of the raised pallet, remove a set of two box pieces 22, 23 from the stack and hand-feed the pieces into the machine 10. When the loaded pallet is emptied, the lift 21 is returned to the ground elevation and the emptied pallet removed. A second loaded pallet is placed on the lift 21 and raised to the in-feed elevation. Preferably, the lift 21 has a support capacity of up to 8,000 pounds.

In-Feed Section 12

Figure 3:
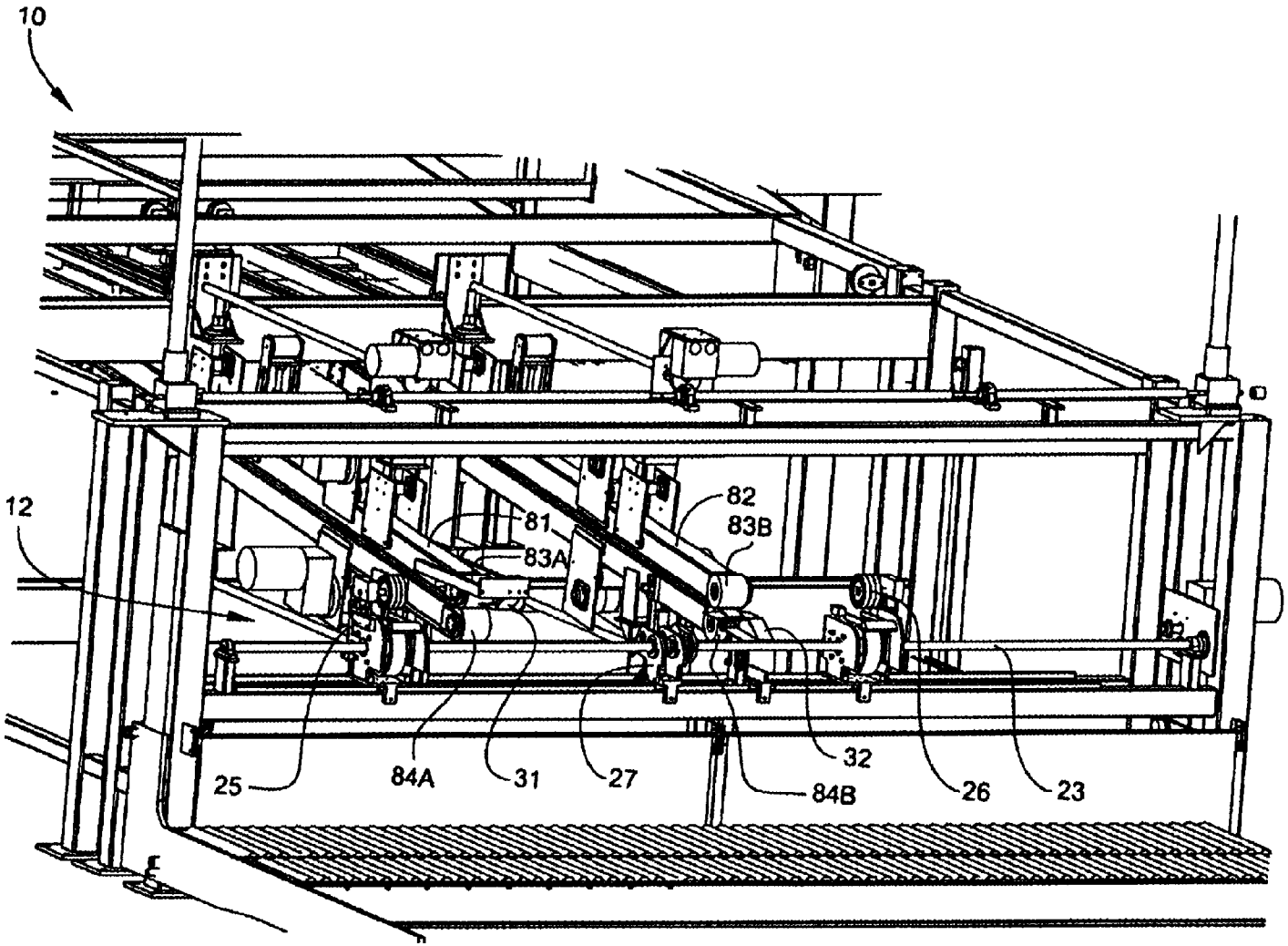
FIG. 3 is an enlarged fragmentary view of the box seaming machine, and showing the components of the in-feed section with the box pieces removed.

Referring to FIGS. 2 and 3, from the mechanical lift 21, the two box pieces 22, 23 are aligned and squared by the operators, and hand-fed to the in-feed section 12 of the machine 10. As best shown in FIG. 3, the in-feed section 12 includes two spaced-apart adjustable drive roller assemblies 25 and 26 and an intermediate guide roller 27 each carried on a lateral spline shaft 28. The spline shaft 28 is operatively connected to an electric motor which rotates the shaft 28, and each of the attached drive roller assemblies 25, 26 and guide roller 27 in unison to achieve exact corresponding downstream movement of the two box pieces 22, 23 into the machine 10.

Figure 4:
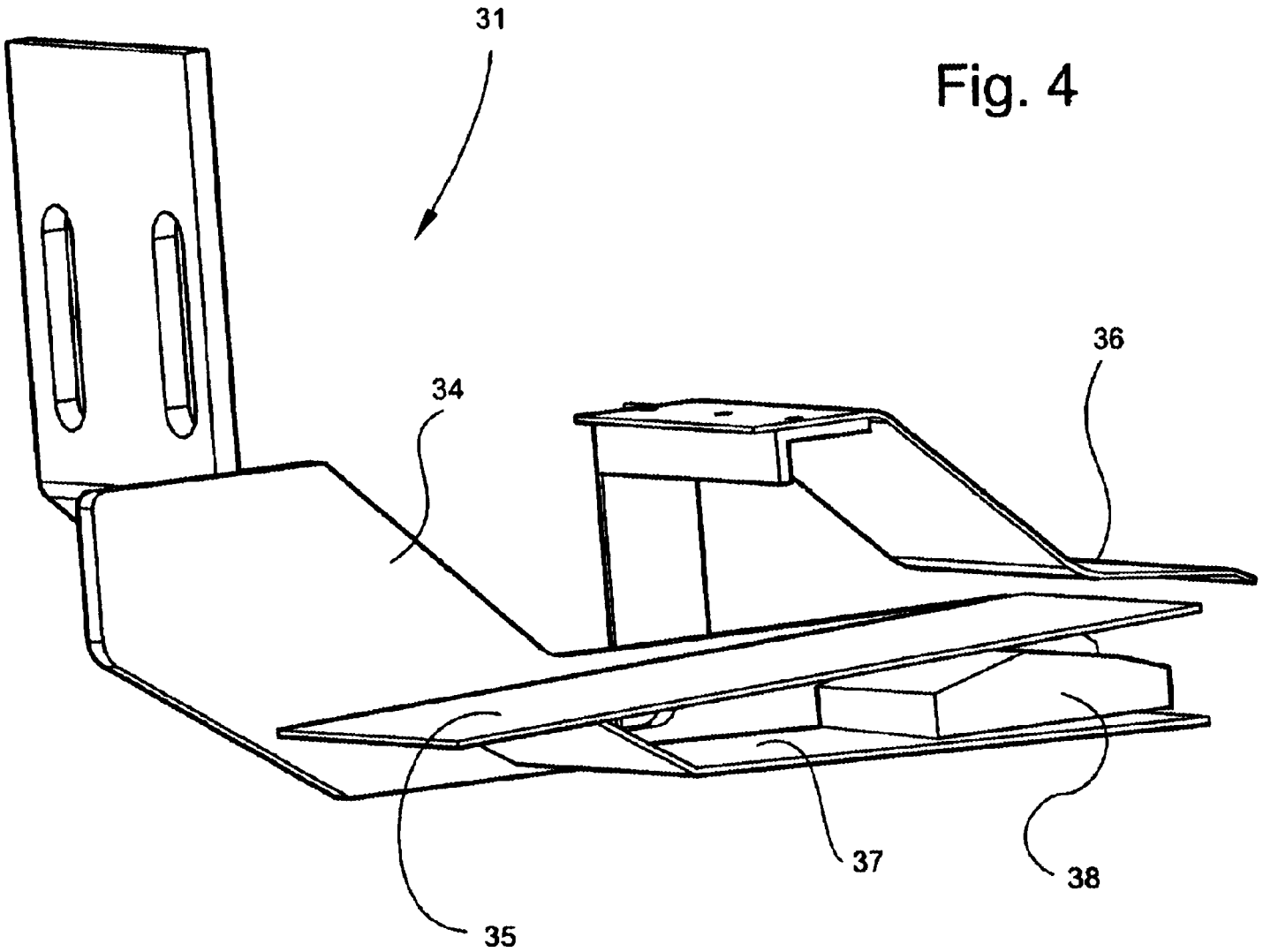
FIG. 4 is an isolated, perspective view of the upper glue shoe assembly.
Figure 5:
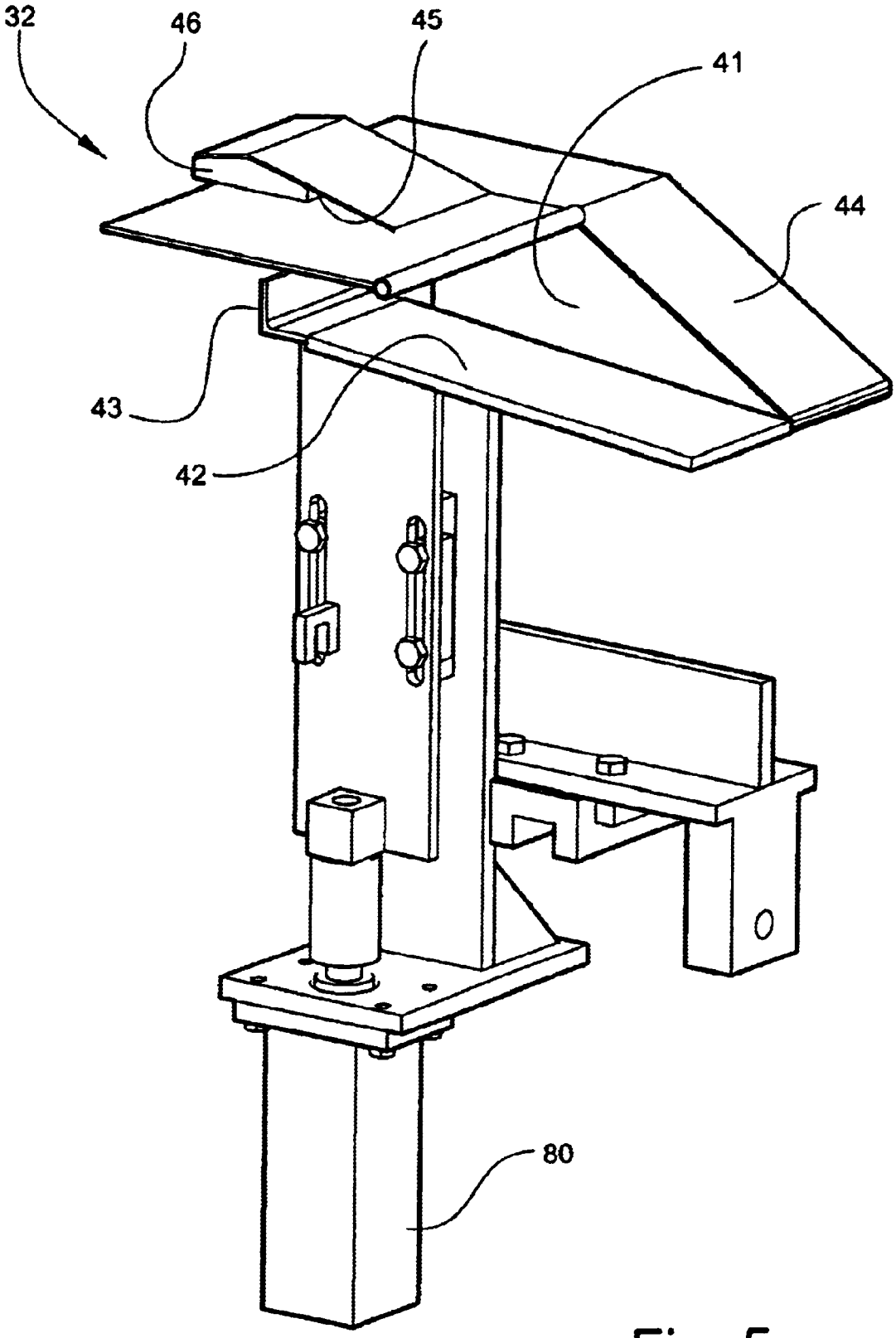
FIG. 5 is an isolated, perspective view of the lower glue shoe assembly.

Upper and lower glue shoe assemblies 31 and 32 are located at the in-feed section 12, and in adjusted lateral alignment with the two (yet to be secured) seams of the unassembled box. The upper shoe assembly 31, shown in FIG. 4, has an edge guide surface 34, an inclined guide ramp 35, an upper guide arm 36, and a glue cavity 37 for storing a cold glue head 38. The edge guide surface 34 engages the free edge of the top panel 22A of the first box piece 22 to properly square and align the first box piece 22 prior to seaming. The lower glue shoe assembly 32, shown in FIG. 5, has an edge guide surface 41, a flat support surface 42 with a back stop 43, an inclined guide ramp 44, and a glue cavity 45 for storing a second cold glue head 46. The edge guide surface 41 engages the free edge of the bottom panel 23B of the second box piece 23, and cooperates with the flat support surface 42 and back stop 43 to square and align the second box piece 23 prior to seaming.

Figure 7:
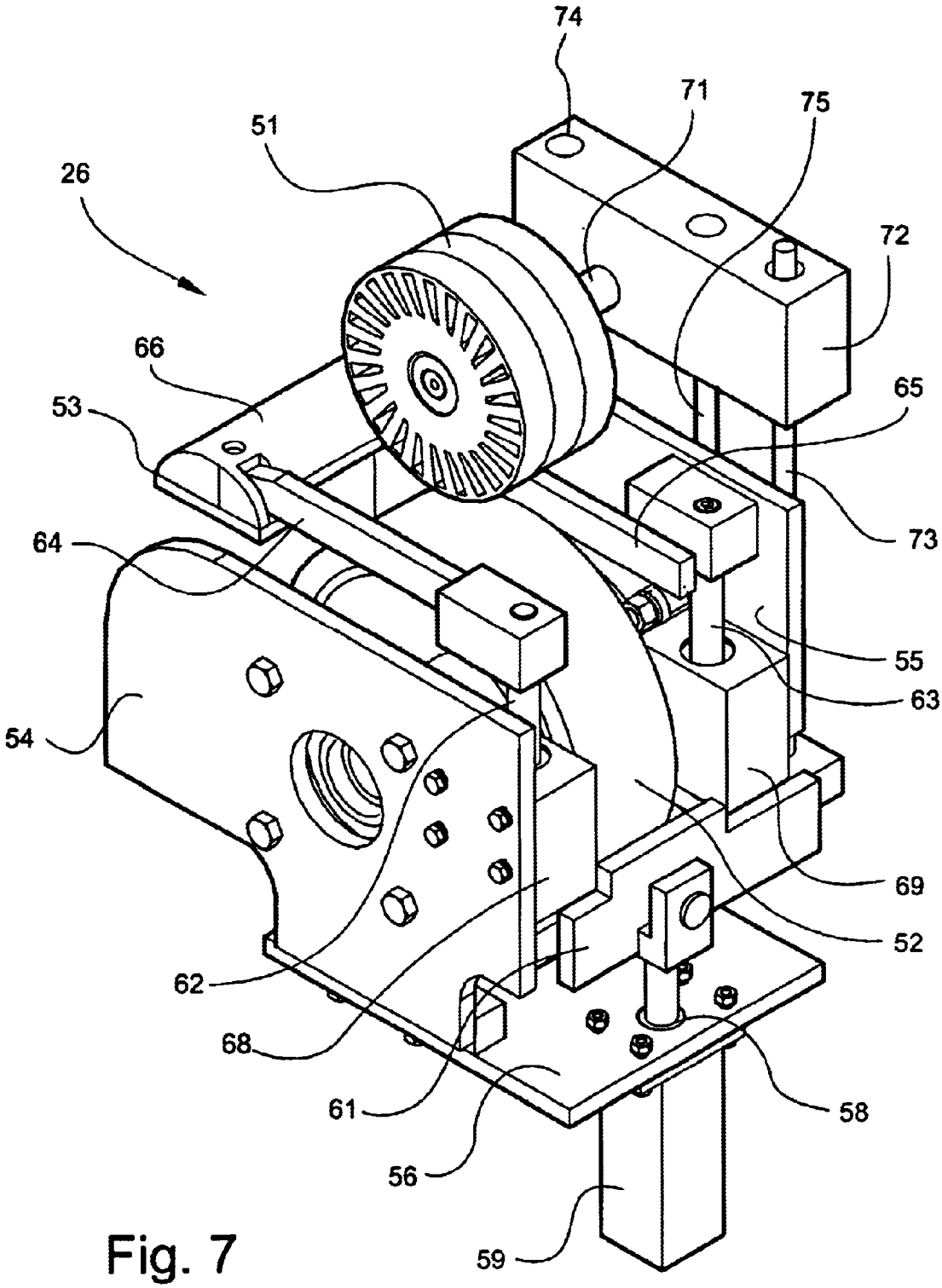
FIG. 7 is an isolated, perspective view of the drive roller assembly in the raised, idle position with the upper drive roller spaced apart from the lower drive roller.
Figure 8:
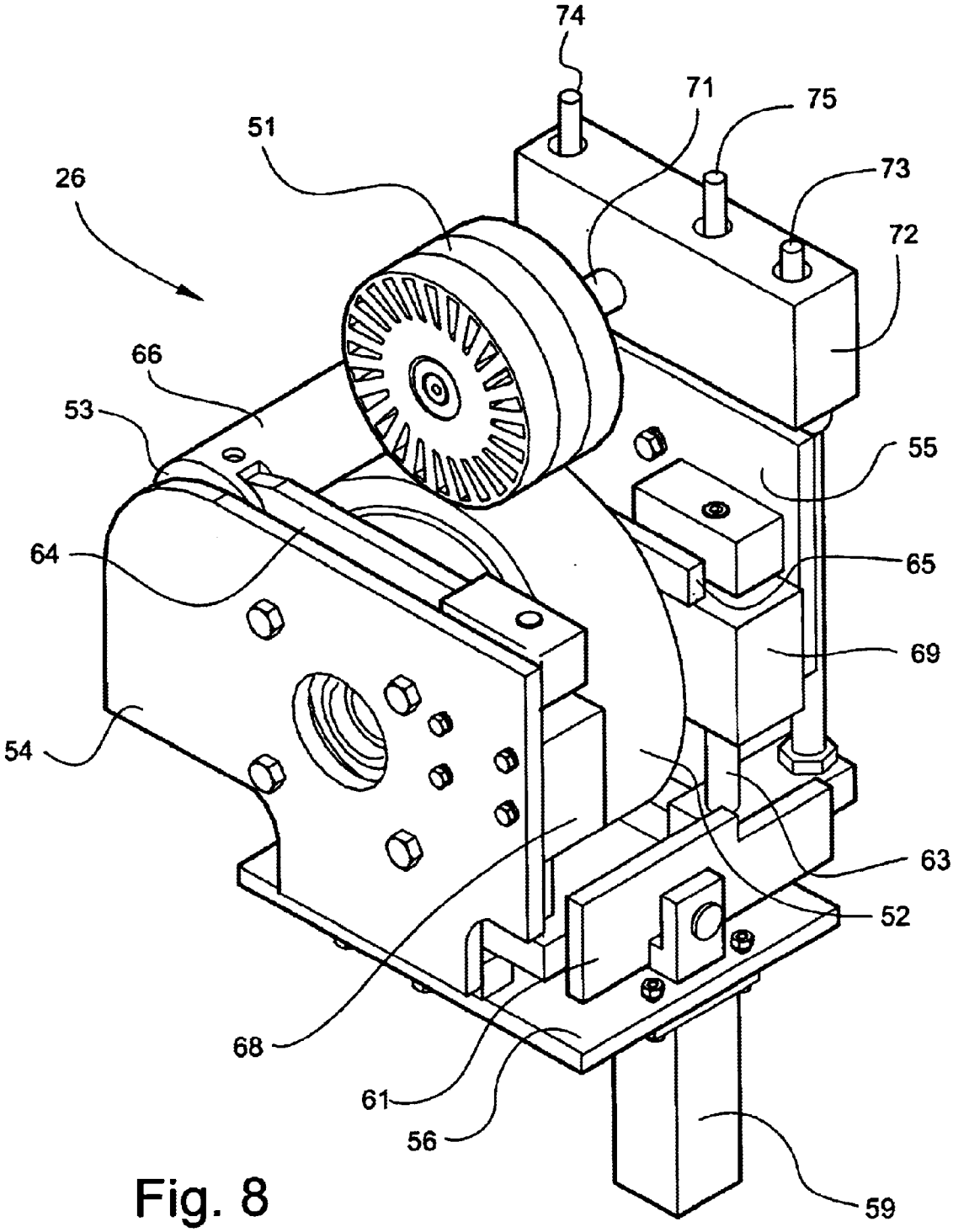
FIG. 8 is an isolated, perspective view of the drive roller assembly in the lowered, operative position with the upper drive roller closely spaced to the lower drive roller.

When positioning the box pieces 22 and 23 at the in-feed section 12, the drive roller assemblies 25 and 26 are each located in an idle position shown in FIG. 6. A single drive roller assembly 26 is shown in greater detail in FIGS. 7 and 8, and described further below. Drive roller assembly 25 includes identical elements and operates in an identical manner. Referring to FIGS. 7 and 8, the drive roller assembly 26 includes upper and lower rollers 51 and 52, and a lift carriage 53 which operates to raise and lower the upper roller 51 and box piece 22 relative to the lower roller 52. The lift carriage 53 is located between opposing side plates 54 and 55 and a base plate 56. The base plate 56 is connected to an air cylinder 59, and includes an opening 58 for accommodating extension and retraction of the cylinder 59. The lift carriage 53 has a base 61 connected to the air cylinder 59, a pair of vertical support rods 62, 63, a pair of arms 64, 65 connected to the support rods 62, 63, and a cross ramp 66 connected to free ends of the arms 64, 65. The vertical support rods 62 and 63 are mounted to the base 61, and adapted to slide within respective guide blocks 68 and 69 mounted to the sides plates 54 and 55. The upper roller 51 is rotatably connected along a support shaft 71 to a guide block 72. The guide block 72 is positioned above the carriage 53, and connected to a vertical support rod 73 mounted to the base 61 outside of the side plate 55. Vertical guide rods 74 and 75 extend through the block 72 to guide vertical movement of the upper roller 51.

Upon actuation of the air cylinder 59, the carriage 53 moves vertically downward from the raised position shown in FIG. 7, to the lowered position, shown in FIG. 8. In the raised position, the upper drive roller 51 is spaced away from the lower drive roller 52, and the arms 64, 65 and cross ramp 66 of the carriage 53 are located at an elevation slightly higher than the outer periphery of the lower drive roller 52. In this idle position, the box panels 22 and 23 can be freely manipulated by the operators without engagement by the roller assemblies 25 and 26. In the lowered operative position, the arms 64, 65 and cross ramp 66 of the carriage 53 move below the outer periphery of the lower drive roller 52, while the upper drive roller 51 moves into closely spaced relation to the lower drive roller 52.

Once the box pieces 22 and 23 are properly positioned and aligned at the in-feed section 12 of the machine 10, the upper rollers 51 of the drive roller assemblies 25 and 26 are lowered by respective air cylinders 59 from their idle positions, shown in FIG. 6, to their operative positions shown in FIG. 9. The carriages 53 simultaneously lower the two box pieces 22 and 23 downwardly onto the lower rollers 52, as previously described. The upper and lower rollers 51 and 52 frictionally engage and sandwich the box pieces 22, 23, and move them downstream in unison through the in-feed section 12. As the box pieces 22, 23 move downstream, the glue head 38 of the upper glue shoe assembly 31 applies glue to the marginal free edges of the top panel 23A of the first box piece 23. The box panel 22A slides along the inclined guide ramp 35, shown in FIG. 4, where it temporarily separates from the box panel 23A and moves over the glue head 38. Simultaneously, the box panel 23A slides against a bottom surface of the glue shoe assembly 31, and under the glue head 38. A downwardly curved lip formed on the upper guide arm 36 directs the box panel 22A of the first box piece 22 downwardly against the glue head 38 and back into engagement with the box panel 23A of the second box piece 23 where the glued panels 22A and 23A are joined together at overlapping marginal edges. The glued overlapping marginal edges form the first seam of the box.

The bottom panel 23B of the second box 23 piece is carried by the guide roller 27, as shown in FIG. 9. The marginal free edge of this panel 23B engages the edge guide surface 41 of the lower glue shoe assembly 32, shown in FIG. 5, and initially, the back stop 43. The bottom panel 22B of the first box piece 22 rides along the inclined guide ramp 44. As the box pieces 22 and 23 are readied for downstream movement, the lower glue shoe assembly 32 drops slightly by operation of an air cylinder 80 in order to disengage the edge of the panel 23B from the back stop 43. The edge of the panel 23B moves into the open space above the back stop 43 and below the glue head 46. As the box pieces 22 and 23 move downstream, the second glue head 46 applies glue to the marginal edge of the bottom panel 23B. The glued marginal edges of the bottom panels 22B, 23B form the second seam of the box.

Seam Curing Section 14

Referring again to FIGS. 1, 2, and 3, after gluing, the box pieces 22 and 23 enter the seam curing section 14 of the machine 10 including two pairs of laterally spaced compression arms 81 and 82. The compression arms 81 and 82 are adjusted laterally to align with corresponding seams of the box, and extend downstream at an incline to the box output section 15. The angle of incline is preferably 5 degrees. As best shown in FIG. 3, each pair of compression arms 81, 82 includes upper and lower nip rollers 83A, 83B and 84A, 84B which grab the box pieces 22 and 23 from the in-feed section 12, compress the pieces at the newly formed seams, and move the pieces further downstream through a curing zone 85 (See FIG. 1) defined by the longitudinal dimension of the arms 81 and 82. In the curing zone 85, constant uniform pressure is applied to the box seams in order to speed curing of the glue. The compression arms 81 and 82 support the box pieces 22 and 23 through the curing zone 85 to avoid deformation of the material during the curing process.

In order to maintain proper alignment of the joined box pieces 22 and 23, each of the compression arms 81 and 82 includes respective upper and lower motor-driven belts which operate independently at speeds identical to that of the drive roller assemblies 25 and 26. Preferably, the four belt motors of the compression arms 81, 82 and the spline shaft motor are controlled with one graduated dial for convenient incremental feed adjustment. The feed rate through the machine 10 is typically between 1 and 2 ft/sec. The amount of compression applied by the arms 81, 82 in the curing zone 85 is defined by the type of corrugated material being run, and controlled by the distance between the nip rollers 83A, 83B and 84A, 84B which are easily adjusted by the operator.

Box Output Section 15

From the seam curing section 14, the assembled two-piece box enters the output section 15 of the machine 10 where the box is squared and discharged. Boxes accumulate in an organized stack on a pallet carried by a mechanical elevator 91 shown in FIG. 1. The elevator 91 is automatically lowered by an operator in small increments as successive boxes are produced and stacked. Upon accumulating a requisite number of boxes, the lift arm lowers the elevator to a ground position where the stack is removed for banding. The elevator is then raised back to the box loading position ready for the next box run.

A one-pass box seaming machine is described above. Various details of the invention may be changed without departing from its scope. Furthermore, the foregoing description of the preferred embodiment of the invention and the best mode of practicing the invention are provided for the purpose of illustration only and not for the purpose of limitation—the invention being defined by the claims.

We claim:

1. A box seaming machine for assembling an oversized box comprising first and second box pieces, each of the box pieces being folded to form top and bottom panels having respective proximal edges joined together at the fold and respective free edges opposite the joined edges, the free edges of the first box piece adapted for being secured to the free edges of the second box piece to define first and second seams of the assembled box, said box seaming machine comprising:

(a) a pair of laterally-spaced, opposing drive roller assemblies adapted for movement between an idle position and an operative position, such that in the idle position, the drive roller assemblies are disengaged from the box pieces to enable alignment of the free edges prior to seaming, and in the operative position, the drive roller assemblies frictionally engage the box pieces at respective folds and feed the box pieces downstream for seaming;

(b) first and second cylinders for moving respective drive roller assemblies between the idle and operative positions; and (c) first and second seam fasteners downstream of said drive roller assemblies for securing the seams at respective free edges of the first and second box pieces to form an assembled, two-piece box.

2. A box seaming machine according to claim 1, wherein said drive roller assemblies are carried on a common drive shaft such that the box pieces are fed into the machine at corresponding rates.

3. A box seaming machine according to claim 1, wherein said drive roller assemblies comprise respective upper and lower rollers.

4. A box seaming machine according to claim 3, wherein said drive roller assemblies comprise respective lift carriages, each of said lift carriages being mounted adjacent said lower roller such that when said drive roller assembly is in the idle position, said lift carriage supports the box piece above the lower roller, and when said drive roller assembly is in the operative position, said lift carriage moves away from the box piece to position the box piece on the lower roller.

5. A box seaming machine according to claim 4, wherein said upper rollers are mounted to respective lift carriages, and move in unison with said carriages upon movement of the drive roller assemblies between the idle and operative positions.

6. A box seaming machine according to claim 1, and comprising a guide roller located between said drive roller assemblies for supporting and guiding one or more of the box panels as the box pieces move downstream into the machine.

7. A box seaming machine according to claim 1, wherein said seam fasteners comprise respective upper and lower glue shoe assemblies adapted for simultaneously applying glue to respective free edges of the box pieces to secure the seams of the assembled box.

8. A box seaming machine according to claim 7, wherein said upper glue shoe assembly defines a cavity for storing a cold glue head.

9. A box seaming machine according to claim 8, wherein said upper glue shoe assembly comprises an edge guide surface for guiding one of the first and second box pieces into the machine during seaming.

10. A box seaming machine according to claim 7, wherein said lower glue shoe assembly defines a cavity for storing a cold glue head.

11. A box seaming machine according to claim 10, wherein said lower glue shoe assembly comprises an edge guide surface for guiding one of the first and second box pieces into the machine during seaming.

12. A box seaming machine according to claim 11, wherein said lower glue shoe assembly further comprises a flat support surface extending perpendicular to said edge guide surface, and cooperating with said edge guide surface to square and align one of the first and second box pieces prior to seaming.

13. A box seaming machine according to claim 12, wherein said lower glue shoe assembly further comprises a stop formed at a back end of said support surface, and extending perpendicular to said support surface to further square and align one of the first and second box pieces prior to seaming.

14. A box seaming machine according to claim 13, and comprising a cylinder for lowering the support surface of said lower glue shoe assembly to disengage the box piece from said stop prior to downstream movement of the box piece into the machine.

15. A box seaming machine according to claim 7, and comprising first and second laterally-spaced compression arms downstream of said upper and lower glue shoe assemblies, and arranged to receive the assembled box pieces at the glued seams to compress the seams in a curing zone as the box pieces move downstream through the machine.

16. A box seaming machine according to claim 15, and comprising first and second pairs of upper and lower nip rollers located at respective leading ends of the compression arms, and cooperating to pull the box pieces from the glue shoe assemblies and into said curing zone.

17. A box seaming machine according to claim 16, wherein said first and second compression arms extend downstream at an incline such that the box pieces are fed into the machine at a relatively low elevation, and are discharged from the machine at a higher elevation.

18. A box seaming machine according to claim 17, and comprising a box elevator located at an output end of the machine for receiving assembled boxes after seaming, and lowering the boxes to an elevation for unloading.

19. A box seaming machine for assembling an oversized box comprising first and second box pieces, each of the box pieces being folded to form top and bottom panels having respective proximal edges joined together at the fold and respective free edges opposite the joined edges, the free edges of the first box piece adapted for being secured to the free edges of the second box piece to define first and second seams of the assembled box, said box seaming machine comprising:

(a) a pair of laterally-spaced drive roller assemblies adapted for movement between an idle position and an operative position, such that in the idle position, the drive roller assemblies are disengaged from the box pieces to enable alignment of the free edges prior to seaming, and in the operative position, the drive roller assemblies frictionally engage the box pieces at respective folds and feed the box pieces downstream for seaming;

(b) first and second cylinders for moving respective drive roller assemblies between the idle and operative positions;

(c) a drive shaft carrying said drive roller assemblies, and actuating said drive roller assemblies at identical speeds such that the first and second box pieces enter the machine at corresponding identical feed rates;

(d) first and second glue shoe assemblies downstream of said drive roller assemblies for applying glue to respective free edges of the box panels to secure the seams of the assembled first and second box pieces.

20. A box seaming method for assembling an oversized box comprising first and second box pieces, each of the box pieces being folded to form top and bottom panels having respective proximal edges joined together at the fold and respective free edges opposite the joined edges, said method comprising the steps of:

(a) aligning the box pieces at an in-feed section of a box seaming machine such that the free edges of the top panels of the box pieces overlap to form a first seam, and the free edges of the bottom panels of the box pieces overlap to form a second seam;

(b) clamping the box pieces at respective folds between upper and lower rollers of respective first and second drive roller assemblies, the drive roller assemblies being actuated by respective cylinders for movement between an idle position and an operative position, such that in the idle position, the drive roller assemblies are disengaged from the box pieces to enable alignment of the free edges prior to seaming, and in the operative position, the drive roller assemblies frictionally engage the box pieces at respective folds and feed the box pieces downstream for seaming;

(c) actuating the drive roller assemblies in unison to move the box pieces downstream at corresponding feed rates; and (d) as the box pieces move downstream, fastening the first and second seams to form an assembled, oversized box.

21. A box seaming machine for assembling an oversized box comprising first and second box pieces, each of the box pieces being folded to form top and bottom panels having respective proximal edges joined together at the fold and respective free edges opposite the joined edges, the free edges of the first box piece adapted for being secured to the free edges of the second box piece to define first and second seams of the assembled box, said box seaming machine comprising:

(a) a pair of laterally-spaced, opposing drive roller assemblies comprising respective upper and lower rollers adapted for movement between an idle position and an operative position, such that in the idle position, the drive roller assemblies are disengaged from the box pieces to enable alignment of the free edges prior to seaming, and in the operative position, the drive roller assemblies frictionally engage the box pieces at respective folds and feed the box pieces downstream for seaming, and each of said drive roller assemblies comprising a lift carriage mounted adjacent said lower roller such that when said drive roller assembly is in the idle position, said lift carriage supports the box piece above the lower roller, and when said drive roller assembly is in the operative position, said lift carriage moves away from the box piece to position the box piece on the lower roller; and (b) first and second seam fasteners downstream of said drive roller assemblies for securing the seams at respective free edges of the first and second box pieces to form an assembled, two-piece box.

22. A box seaming machine for assembling an oversized box comprising first and second box pieces, each of the box pieces being folded to form top and bottom panels having respective proximal edges joined together at the fold and respective free edges opposite the joined edges, the free edges of the first box piece adapted for being secured to the free edges of the second box piece to define first and second seams of the assembled box, said box seaming machine comprising:

(a) a pair of laterally-spaced, opposing drive roller assemblies adapted for movement between an idle position and an operative position, such that in the idle position, the drive roller assemblies are disengaged from the box pieces to enable alignment of the free edges prior to seaming, and in the operative position, the drive roller assemblies frictionally engage the box pieces at respective folds and feed the box pieces downstream for seaming; and (b) first and second seam fasteners downstream of said drive roller assemblies for securing the seams at respective free edges of the first and second box pieces to form an assembled, two-piece box, and said seam fasteners comprising respective upper and lower glue shoe assemblies adapted for simultaneously applying glue to respective free edges of the box pieces to secure the seams of the assembled box, and each of said lower glue shoe assemblies defining a cavity for storing a cold glue head, an edge guide surface for guiding one of the first and second box pieces into the machine during seaming, and a flat support surface extending perpendicular to said edge guide surface and cooperating with said edge guide surface to square and align one of the first and second box pieces prior to seaming.

* * * * *